US010315200B2

(12) United States Patent
Abebaw et al.

(10) Patent No.: US 10,315,200 B2
(45) Date of Patent: Jun. 11, 2019

(54) APPARATUS AND SYSTEM FOR STORING AND TRANSPORTING MAGNETIC DEVICES

(71) Applicant: Intel Corporation, Santa Clara, CA (US)

(72) Inventors: Amanuel M Abebaw, Chandler, AZ (US); Mark Saltas, Chandler, AZ (US); Anna M. Prakash, Chandler, AZ (US); Liwei Wang, Phoenix, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/638,167

(22) Filed: Jun. 29, 2017

(65) Prior Publication Data

US 2019/0001342 A1 Jan. 3, 2019

(51) Int. Cl.

| | |
|---|---|
| ***B25H 3/06*** | (2006.01) |
| ***B03C 1/034*** | (2006.01) |
| ***B03C 1/00*** | (2006.01) |
| *B65B 5/02* | (2006.01) |
| *B65B 11/50* | (2006.01) |

(52) U.S. Cl.

CPC ..... *B03C 1/034* (2013.01); *B03C 1/002* (2013.01); *B25H 3/06* (2013.01); *B65B 5/026* (2013.01); *B65B 11/50* (2013.01)

(58) Field of Classification Search

CPC ..... A45C 11/00; A45C 11/26; B03C 1/002; B03C 1/034; B65B 5/026; B65B 11/50; B65D 69/00; B65D 85/00; H01F 7/02; H01F 7/20; B25H 3/00; B25H 3/003; B25H 3/06

USPC ..... 206/350, 818; 335/285

See application file for complete search history.

(56) References Cited

U.S. PATENT DOCUMENTS

| | | | | |
|---|---|---|---|---|
| 2,921,388 A * | 1/1960 | Stefaney | G09B 1/08 | 335/285 |
| 3,186,673 A * | 6/1965 | Olson | A47B 31/06 | 211/86.01 |
| 5,221,006 A * | 6/1993 | Plumlee | A45C 11/00 | 206/350 |
| 6,181,229 B1 * | 1/2001 | Anderson | B25B 9/00 | 206/350 |

(Continued)

FOREIGN PATENT DOCUMENTS

JP 6-191574 A * 12/1994

*Primary Examiner* — Bryon P Gehman

(74) *Attorney, Agent, or Firm* — Schwegman Lundberg & Woessner, P.A.

(57) ABSTRACT

An apparatus for storing magnetic materials may include a tray. The apparatus for storing magnetic materials may include a sheet. The apparatus for storing magnetic materials may include a first set of height modulators. The apparatus for storing magnetic materials may include a diamagnetic material. The tray may include one or more pockets. The one or more pockets may be configured to receive a magnetic device. The sheet may be configured to couple with the tray. The sheet may be located adjacent to a bottom of the one or more pockets. The sheet may include the diamagnetic material. The sheet may include the first set of height modulators. The first set of height modulators may protrude from a surface of the sheet. The first set of height modulators may be configured to extend into the one or more pockets at a first distance.

31 Claims, 4 Drawing Sheets

(56) References Cited

U.S. PATENT DOCUMENTS

| | | | | |
|---|---|---|---|---|
| 8,256,618 | B2 * | 9/2012 | Schein | B25H 3/06<br>206/818 |
| 9,975,237 | B2 * | 5/2018 | Norris | B25H 3/003 |
| 2012/0325695 | A1 * | 12/2012 | Schein | B25H 3/06<br>335/285 |
| 2014/0021317 | A1 * | 1/2014 | Wu | G02B 7/021<br>248/346.03 |
| 2018/0001468 | A1 * | 1/2018 | Pang | B25H 3/003 |

* cited by examiner

APPARATUS AND SYSTEM FOR STORING AND TRANSPORTING MAGNETIC DEVICES

BACKGROUND

Magnetic devices may be stored and/or transported in a variety of ways. Storage options for magnetic devices may include stacking the magnetic devices in a tube (e.g., similar to a coin tube), placing the magnetic devices in a gel pack, or positioning the magnetic devices on a substrate and then shrink wrapping the assembly.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
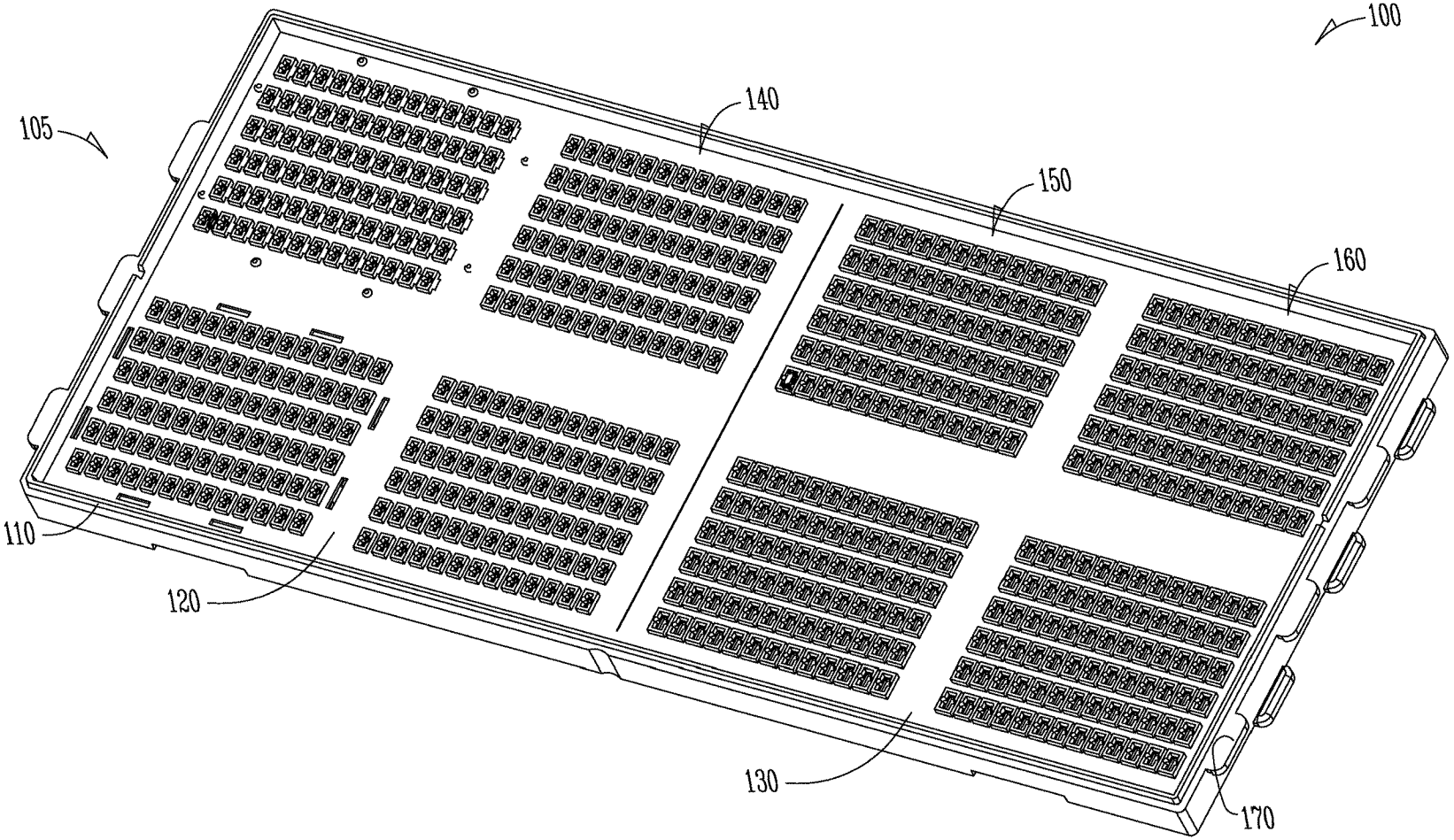
FIG. 1 illustrates a portion of a system for storing magnetic devices.

The present inventors have recognized, among other things, that a problem to be solved may include storing magnetic devices in close proximity. The present inventors have recognized, among other things, that a problem to be solved may also include preventing a magnetic device from reorienting itself when exposed to external magnetic fields. The present inventors have recognized, among other things, that a problem to be solved may also include preventing a magnetic device from reorienting itself when placed in closed proximity to a ferrous material.

The present subject matter may help provide a solution to this problem, such as by using a system for storing magnetic materials. The system for storing magnetic materials may include a magnetic device and an apparatus for storing magnetic materials. The apparatus for storing magnetic materials may include a tray. The apparatus for storing magnetic materials may include a sheet. The apparatus for storing magnetic materials may include a first set of height modulators. The apparatus for storing magnetic materials may include a diamagnetic material. The apparatus for storing magnetic materials may include a ferromagnetic material.

The tray may include one or more pockets. The one or more pockets may be configured to receive a magnetic device. The sheet may be configured to couple with the tray. The sheet may be located adjacent to a bottom of the one or more pockets. The sheet may include the diamagnetic material. The sheet may include the ferromagnetic material. The sheet may include the first set of height modulators. The first set of height modulators may protrude from a surface of the sheet. The first set of height modulators may be configured to extend into the one or more pockets at a first distance.

The apparatus for storing and transporting magnetic materials may allow for magnetic devices to be stored in close proximity by using the diamagnetic material and/or the ferromagnetic material to localize the attractive forces between the magnetic devices. The magnetic devices may be in a JEDEC tray or arranged along a flat plane. Localizing the attractive forces may include dissipating the attractive forces between the magnetic devices such that a first magnetic device, positioned within a first pocket, may not cause a second magnetic device, positioned within a second pocket, to reorient itself within the second pocket (or vice-versa).

The apparatus for storing magnetic materials may allow for the position or orientation of magnetic devices to remain unchanged when exposed to external magnetic fields, such as by using the diamagnetic material and/or the ferromagnetic material to diminish the interaction of the external magnetic fields with the magnetic devices. The apparatus for storing magnetic materials may allow for the position or orientation of magnetic devices to remain unchanged when in proximity to a ferrous material, such as by using the diamagnetic material to diminish the attractive forces between the magnetic devices and the ferrous material.

Aspect 1 may include or use subject matter (such as an apparatus, a system, a device, a method, a means for performing acts, or a device readable medium including instructions that, when performed by the device, may cause the device to perform acts), such as may include or use an apparatus ("the apparatus") for storing magnetic materials. The apparatus may include a tray. The tray may include one or more pockets. The one or more pockets may be configured to receive a magnetic device. The apparatus may include a sheet. The sheet may be configured to couple with the tray. The sheet may be located adjacent to a bottom of the one or more pockets. The sheet may include a diamagnetic material. The sheet may include a ferromagnetic material. The sheet may include a first set of height modulators. The first set of height modulators may protrude from a surface of the sheet. The first set of height modulators may be configured to extend into the one or more pockets at a first distance.

Aspect 2 may include or use, or may optionally be combined with the subject matter of Aspect 1, to optionally include or use that the diamagnetic material includes bismuth, gold, copper, silver, mercury, and/or lead. The ferromagnetic material may include iron, nickel, cobalt, and/or gadolinium or an alloy thereof.

Aspect 3 may include or use, or may optionally be combined with the subject matter of one or any combination of Aspects 1 or 2 to optionally include or use that the sheet may include a composite material. The composite material may include a dielectric matrix. The composite material may include a dispersed phase. The dispersed phase may include the diamagnetic material. The dispersed phase may include the ferromagnetic material.

Aspect 4 may include or use, or may optionally be combined with the subject matter of one or any combination of Aspects 1 through 3 to optionally include or use that the sheet may be a first sheet. The tray may include a first section. The tray may include a second section. The first sheet may be configured to couple with the first section of the tray. The apparatus may include a second sheet. The second sheet may be configured to couple with the second section of the tray. The second sheet may include the diamagnetic material. The second sheet may include a second set of height modulators. The second set of height modulators may protrude from a surface of the second sheet. The second set of height modulators may be configured to extend into the one or more pockets.

Aspect 5 may include or use, or may optionally be combined with the subject matter of Aspect 4 to optionally include or use that the first set of height modulators may have a first height. The second set of height modulators may have a second height. The first height may be different than the second height.

Aspect 6 may include or use, or may optionally be combined with the subject matter of one or any combination of Aspect 4 or 5 to optionally include or use that the one or more pockets of the first section may have a first set of dimensions. The one or more pockets of the second section may have a second set of dimensions. The first set of dimensions may be different than the second set of dimensions.

Aspect 7 may include or use, or may optionally be combined with the subject matter of one or any combination of Aspects 1 through 6 to optionally include or use that the one or more height modulators may include the diamagnetic material or the ferromagnetic material.

Aspect 8 may include or use, or may optionally be combined with the subject matter of one or any combination of Aspects 1 through 7 to optionally include or use that the one or more pockets may each include an opening. The opening for each of the one or more pockets may be configured to receive the first set height modulators.

Aspect 9 may include or use, or may optionally be combined with the subject matter of one or any combination of Aspects 1 through 8 to optionally include or use that the first set of height modulators may include a first height modulator and a second height modulator. The first height modulator may have a first height. The second height modulator may have a second height. The first height may be different than the second height.

Aspect 10 may include or use, or may optionally be combined with the subject matter of one or any combination of Aspects 1 through 9 to optionally include or use a spacer. The spacer may be configured to mate with the tray or the sheet. The spacer may be configured to be positioned between the tray and the sheet. The spacer may be configured to mate with each of the first set of height modulators such that an overall height of the first set of height modulators is reduced. The spacer may be configured to mate with each of the first set of height modulators such that an overall height of the first set of height modulators is increased.

Aspect 11 may include or use, or may optionally be combined with the subject matter of one or any combination of Aspects 1 through 10 to optionally include or use that a spacer. The spacer may include the diamagnetic material. The spacer may be configured to be positioned between the tray and the sheet. Positioning the spacer between the tray and the sheet may configure the first set of height modulators to protrude into the one or more pockets at a second distance. The second distance may be less than the first distance. The second distance may be greater than the first distance.

Aspect 12 may include or use, or may optionally be combined with the subject matter of one or any combination of Aspects 1 through 11 to optionally include or use that the one or more pockets may include a top opening and a bottom opening. The first set of height modulators may protrude into the one or more pockets through the bottom opening. The dimensions of the top opening may be greater than the bottom opening. The top opening may be chamfered.

Aspect 13 may include or use, or may optionally be combined with the subject matter of one or any combination of Aspects 1 through 12 to optionally include or use that the tray or the sheet may be configured to mate with a JEDEC tray.

Aspect 14 may include or use, or may optionally be combined with the subject matter of one or any combination of Aspects 1 through 13 to optionally include or use that the coupling of the sheet with the tray may define a cavity. The cavity may be within the one or more pockets. The cavity may be configured to receive the magnetic device.

Aspect 15 may include or use, or may optionally be combined with the subject matter of one or any combination of Aspects 1 through 14 to optionally include or use that the one or more pockets may include at least one cutout. The at least one cutout may extend into a sidewall of the one or more pockets.

Aspect 16 may include or use, or may optionally be combined with the subject matter of Aspect 15 to optionally include or use that the at least one cutout may be configured to receive a pin.

Aspect 17 may include or use subject matter (such as an apparatus, a system, a device, a method, a means for performing acts, or a device readable medium including instructions that, when performed by the device, may cause the device to perform acts), such as may include or use a system ("the system") for storing magnetic materials. The system may include a tray. The tray may include one or more pockets. The system may include a sheet. The sheet may be configured to couple with the tray. The sheet may be located adjacent to a bottom of the one or more pockets. The sheet may include a diamagnetic material. The sheet may include a ferromagnetic material. The sheet may include a first set of height modulators. The first set of height modulators may protrude from a surface of the sheet. The first set of height modulators may be configured to extend into the one or more pockets at a first distance. The system may include a magnetic device. The one or more pockets may be configured to receive the magnetic device.

Aspect 18 may include or use, or may optionally be combined with the subject matter of Aspect 17, to optionally include or use that the diamagnetic material may include bismuth, gold, copper, silver, mercury, and/or lead. The ferromagnetic material may include iron, nickel, cobalt, and/or gadolinium or an alloy thereof.

Aspect 19 may include or use, or may optionally be combined with the subject matter of one or any combination of Aspects 17 or 18 to optionally include or use that the sheet may include a composite material. The composite material may include a dielectric matrix. The composite material may include a dispersed phase. The dispersed phase may include the diamagnetic material. The dispersed phase may include the ferromagnetic material.

Aspect 20 may include or use, or may optionally be combined with the subject matter of one or any combination of Aspects 17 through 19 to optionally include or use that the one or more pockets may include at least one cutout. The at least one cutout may extend into a sidewall of the one or more pockets.

Aspect 21 may include or use, or may optionally be combined with the subject matter of Aspect 20 to optionally include or use that the at least one cutout may be configured to receive a pin.

Aspect 22 may include or use, or may optionally be combined with the subject matter of one or any combination of Aspects 17 through 21 to optionally include or use a spacer. The spacer may be configured to mate with the tray or the sheet. The spacer may be configured to be positioned between the tray and the sheet. The spacer may be configured to mate with each of the first set of height modulators such that an overall height of the first set of height modulators is reduced. The spacer may be configured to mate with each of the first set of height modulators such that an overall height of the first set of height modulators is increased.

Aspect 23 may include or use, or may optionally be combined with the subject matter of Aspect 22 to optionally include or use that reducing the overall height of the first set of height modulators may increase the attractive force between the magnetic device and the sheet. Increasing the overall height of the first set of height modulators may decrease the attractive force between the magnetic device and the sheet.

Aspect 24 may include or use, or may optionally be combined with the subject matter of one or any combination of Aspects 17 through 23 to optionally include or use that positioning the magnetic device within the one or more pockets may mate the magnetic device with the one or more height modulators.

Aspect 25 may include or use, or may optionally be combined with the subject matter of one or any combination of Aspects 17 through 24 to optionally include or use that the tray or the sheet may be configured to mate with a JEDEC tray.

Aspect 26 may include or use subject matter (such as an apparatus, a system, a device, a method, a means for performing acts, or a device readable medium including instructions that, when performed by the device, may cause the device to perform acts), such as may include or use an apparatus ("the apparatus") for storing magnetic materials. The apparatus may include a tray. The tray may include at least one pocket. The at least one pocket may be configured to receive a magnetic device. The apparatus may include a diamagnetic or a ferromagnetic material. The diamagnetic or a ferromagnetic material may be located adjacent to a bottom of the at least one pocket. The diamagnetic or a ferromagnetic material may be located adjacent to a bottom of the tray. The apparatus may include a height modulator. The height modulator may be disposed between the at least one pocket bottom and the diamagnetic or ferromagnetic material. The height modulator may extend into the at least one at a first distance.

Aspect 27 may include or use, or may optionally be combined with the subject matter of Aspect 26, to optionally include or use that the diamagnetic material includes bismuth, gold, copper, silver, mercury, and/or lead. The ferromagnetic material may include iron, nickel, cobalt, and/or gadolinium or an alloy thereof.

Aspect 28 may include or use, or may optionally be combined with the subject matter of one or any combination of Aspects 26 or 27 to optionally include or use that the height modulator may include the diamagnetic material or the ferromagnetic material.

Aspect 29 may include or use, or may optionally be combined with the subject matter of one or any combination of Aspects 26 through 28 to optionally include or use that the height modulator may be a first height modulator. The apparatus may include a second height modulator. The first height modulator may have a first height. The second height modulator may have a second height. The first height may be different than the second height.

Aspect 30 may include or use, or may optionally be combined with the subject matter of one or any combination of Aspects 26 through 29 to optionally include or use that the tray is configured to mate with a JEDEC tray.

Aspect 31 may include or use, or may optionally be combined with the subject matter of one or any combination of Aspects 26 through 30 to optionally include or use that the at least one pocket may include at least one cutout. The at least one cutout may extend into a sidewall of the at least one pocket.

Aspect 32 may include or use, or may optionally be combined with any portion or combination of any portions of any one or more of Aspects 1 through 31 to include or use, subject matter that may include means for performing any one or more of the functions of Aspects 1 through 31, or a machine-readable medium including instructions that, when performed by a machine, cause the machine to perform any one or more of the functions of Examples 1 through 31.

Each of these non-limiting examples may stand on its own, or may be combined in various permutations or combinations with one or more of the other examples. This overview is intended to provide an overview of subject matter of the present patent application. It is not intended to provide an exclusive or exhaustive explanation of the invention.

FIG. 1 illustrates a portion of a system 100 for storing magnetic devices. The system 100 may include an apparatus 105 for storing magnetic devices. The system 100 may include more than one apparatus 105. The apparatus 105 may include a tray 110. The tray 110 may include a first section 120. The tray 110 may include a second section 130. The tray 110 may include interconnection features 170. The interconnection features 170 may allow for the tray 110 to couple, or mate, with additional elements, such as a second apparatus (not shown). The interconnection features 170 may allow for the tray 110 to couple, or mate, with a JEDEC tray. Stated another way, the tray 110 (or the apparatus 100) may be configured to comply with the standards defining the dimensions and features of a JEDEC tray.

The first section 120 of the tray 110 may include one or more pockets. The second section 130 of the tray 110 may include a one or more pockets. The first section 120 may include a first set of pockets 140. The second section 130 may include a second set of pockets 150. The first set of pockets 140 may have a first set of dimensions. The second set of pockets 150 may have a second set of dimensions. The first set of dimensions may be the same as the second set of dimensions. The first set of dimensions may be different than the second set of dimensions.

The dimensions of the first set of pockets 140 may include a first length and a first width. The dimensions of the second set of pockets 150 may include a second length and a second width. The first length and the first width may differ from the second length and the second width. The first length and the first width may differ from the second length and the second width depending upon the dimensions of the magnetic devices (not shown) that will be positioned within the first set of pockets 140 or the second set of pockets 150, respectively. In an example, the dimensions of the first set of pockets 140 are configured to accept a first magnetic device (not shown) within each of the pockets of the first set of pockets 140. The dimensions of the second set of pockets 150 are configured to accept a second magnetic device (not shown) within each of the pockets of the second set of pockets 150. The first magnetic device may be smaller than the second magnetic device.

As shown in FIG. 1, the first set of pockets 140 and the second set of pockets 150 are generally rectangular in shape. However, the present subject matter is not so limited. The first set of pockets 140 or the second set of pockets 150 may be generally circular, triangular, square, or any other nth-sided polygon in shape.

Figure 2:
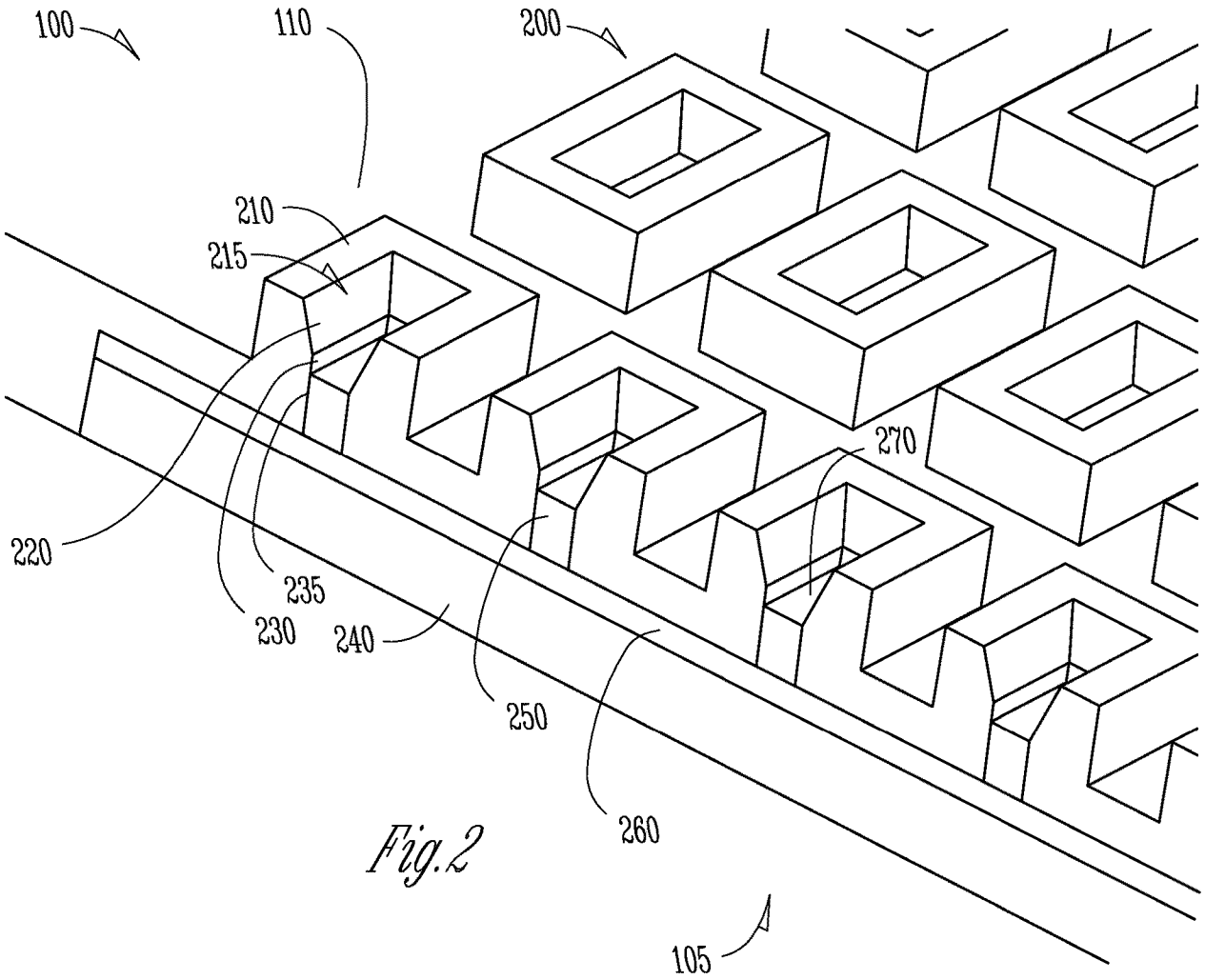
FIG. 2 illustrates a different portion of the system for storing magnetic devices of FIG. 1.

FIG. 2 illustrates a different portion of the system 100 for storing magnetic devices of FIG. 1. The system 100 may include the apparatus 105. The apparatus 105 may include the tray 110. The tray 110 may include one or more pockets, such as a pocket 200. The pocket 200 may be included in the first set of pockets 140 of FIG. 1. The pocket 200 may be included in the second set of pockets 150 of FIG. 1.

The pocket 200 may include pocket sidewalls 210. The pocket sidewalls 210 may define a cavity 215 (e.g., a top opening). The pocket 200 may include a chamfered surface 220. The pocket 200 may include a recess 230. The recess 230 may be configured to have dimensions similar to a magnetic device (not shown), such that a small clearance is provided between the magnetic device and the recess 230. The chamfered surface 220 may provide an angled surface that extends from the pocket sidewalls to the recess 230. The chamfered surface 220 may reduce the area of the cavity from a first area, to a second area. The top of the cavity may have the first area. The recess may have the second area. The chamfered surface 220 may ease the placement of the magnetic device within the cavity of the pocket 200. The chamfered surface 220 may ease the positioning of the magnetic device within the recess 230. The pocket 200 may include an opening 235. The opening 235 may extend into the cavity 215.

The apparatus 105 may include a sheet 240. The sheet 240 may be configured to couple with the tray 110. The sheet 240 may be located adjacent to a bottom 270 of the one or more pockets. Stated another way, coupling the sheet 240 with the tray 110 may define the bottom of the pocket 200. The diamagnetic material or the ferromagnetic material may be located adjacent to a bottom of at least one pocket 200.

The apparatus 105 may include a height modulator 250. The sheet 240 may include a height modulator 250. The height modulator 250 may be disposed between at least one pocket bottom and the diamagnetic or ferromagnetic material. The opening 235 may be configured to receive the height modulator 250. Reception of the height modulator 250 by the opening 235 may define the bottom of the pocket 200. The sheet 240 may include one or more (or a set) of the height modulator 250. The height modulator 250 may protrude from a surface of the sheet 240. The height modulator 250 may be configured to extend into the pocket 200 at a first distance. The height modulator 250 may be configured to extend into the pocket 200 at a second distance (e.g., have a varying height). The height of the height modulator may define the height of the recess 230. Stated another way, the distance that the height modulator 250 extends into the pocket 200 may define the height of the recess 230.

The apparatus 105 may include a spacer 260. The spacer 260 may mate with the height modulator 250 (or one or more of the height modulator 250) such that an overall height of the height modulator 250 is reduced. The spacer 260 may be configured to alter the distance that the height modulator 250 extends into the pocket 200. Altering the distance that the height modulator 250 extends into the pocket 200 may alter the height of the recess 230. The spacer 260 may mate with the tray 110. The spacer 260 may mate with the sheet 240. The spacer 260 may be positioned between the tray 110 and the sheet 240. In an example, positioning the spacer 260 between the tray 110 and the sheet 240 configures a first set of height modulators to protrude into one or more pockets at a second distance, wherein the second distance is less than a first distance that the first set of height modulators originally (e.g., before the spacer 260 was implemented) extended into the one or more pockets.

Figure 3:
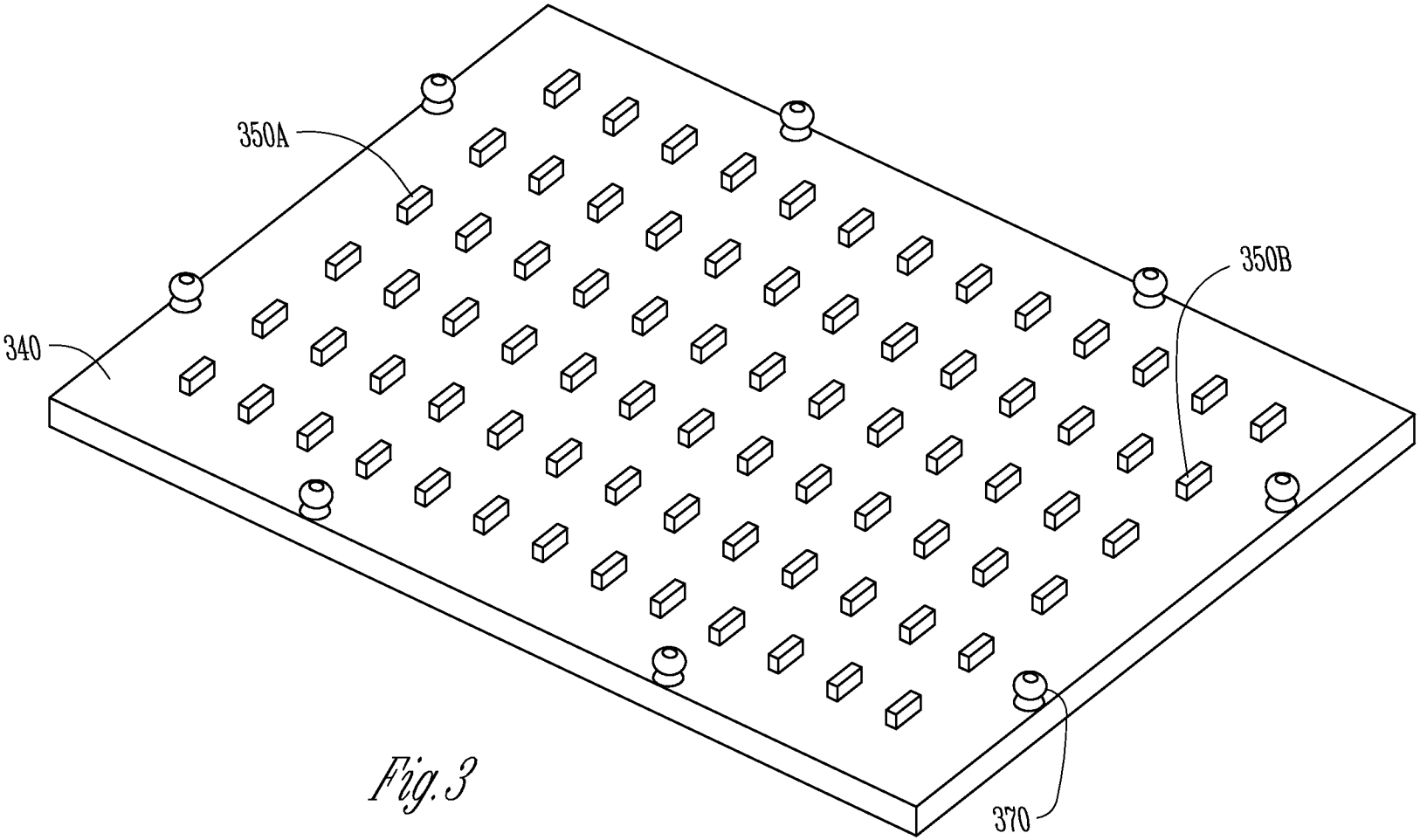
FIG. 3 illustrates a different portion of the system for storing magnetic devices of FIG. 1.

FIG. 3 illustrates a different portion of the system 100 for storing magnetic devices of FIG. 1. As described herein, the system 100 may include the apparatus 105. The apparatus 105 may include a sheet 340. The sheet 340 may be the sheet 240 of FIG. 1. The sheet 340 may include a first height modulator 350A. The sheet 340 may include a second height modulator 350B. The first height modulator 350A may be the height modulator 250 of FIG. 2. The second height modulator 350B may be the height modulator 250 of FIG. 2. The first height modulator 350A may be the same height as second height modulator 350. The first height modulator 350A may be a different height as second height modulator 350B. The first height modulator 350A may have a first length and a first width. The second height modulator 350A may have a second length and a second width. The first width may be the same as the second width. The first width may be different than the second width. The first length may be the same as the second length. The first length may be different than the second length.

The sheet 340 may be a first sheet. The apparatus 105 may include a second sheet (not shown). The second sheet may include all of the features or elements of the first sheet. The second sheet may have differing dimensions (e.g., a length, a width, or a height) than the first sheet. The first sheet may be configured to couple with the first section 120 of the tray 110 of FIG. 1. The second sheet may be configured to couple with the second section 130 of the tray 110 of FIG. 1. Use of the first sheet and the second sheet may allow for the tray 110 to accommodate magnetic devices of varying dimensions and/or shapes. The first sheet may be configured to couple with only the first set of pockets 140, instead of all of the sets of pockets of the first section 120. Stated another way, the sheet 340 may be configured to couple with various sections, or sub-sections, of the tray 110 of FIG. 1.

The tray 110 or the sheet 340 may include a composite material. The composite material may include a dielectric matrix. The dielectric matrix may include a plastic material. The dielectric matrix may be injection moldable. The composite material may include a dispersed phase. The dispersed phase may include a diamagnetic material and/or a ferromagnetic material. The volumetric ratio of the dielectric matrix to the dispersed phase may vary. The volumetric ratio of the diamagnetic material and/or the ferromagnetic material within the dispersed phase may vary. The dielectric matrix may include liquid crystal polymers, carbon tube filled liquid crystal polymers, and/or polyphenylene oxide. The diamagnetic material may include bismuth, gold, copper, silver, mercury, and/or lead. The diamagnetic material may be selected from the group consisting of bismuth, gold, copper, silver, mercury, and lead. The ferromagnetic material may include iron, nickel, cobalt, and/or gadolinium. The ferromagnetic material may include an alloy of iron, nickel, cobalt, and/or gadolinium. The ferromagnetic material may be selected from the group consisting of iron, nickel, cobalt, and gadolinium.

Use of the composite material may allow for the apparatus 105 to localize the attractive forces between adjacent magnetic devices (e.g., in an adjacent pocket) positioned within the apparatus 105 or from external influences (e.g., external magnetic forces or magnetic materials). Localization of the attractive forces may be provided by the dispersed phase within the dielectric matrix. The dispersed phase may allow for the relative isolation of attractive forces caused by a proximate magnetic device.

In an example, the apparatus 105 of FIGS. 1-2 includes a sheet of ferromagnetic material coupled to the bottom of the tray 110. Coupling a plurality of magnetic devices to the apparatus 105 may result in a build-up of magnetic forces within the ferromagnetic material. When the magnetic forces build-up within the ferromagnetic material, the amount of force necessary to remove an individual magnetic device from the apparatus 105 may increase. Stated another way, coupling a plurality of magnetic devices to the apparatus 105, that includes the ferromagnetic material, may make it more difficult to remove an individual magnetic device from the apparatus 105. This is in contrast with the lesser amount of force that would be necessary if just the individual magnetic device were coupled to the apparatus 105. The amount of force necessary to remove an individual magnetic device from the apparatus 105 may increase to a point where it becomes difficult for a pick-and-place apparatus to remove an individual magnetic device from the apparatus 105.

In contrast, the sheet 340 may include the diamagnetic material and/or the ferromagnetic material. The sheet 340 may be coupled to the bottom of the tray 110 of FIGS. 1-2. The inclusion of the diamagnetic material and/or the ferromagnetic material may allow for the localization of the magnetic forces that are generated when one or more magnetic devices are coupled to the apparatus 105. Localization of the magnetic forces may prevent the build-up of magnetic forces within the sheet 340. Preventing the build-up of magnetic forces within the sheet 340 may prevent an increase in force that is necessary to remove an individual magnetic device from the apparatus 105 when a plurality of magnetic devices are coupled to the apparatus 105. Stated another way, coupling a plurality of magnetic devices to the apparatus 105, that includes the sheet 340, may allow for a localization of magnetic forces generated by the individual magnetic devices.

Localizing the magnetic forces may prevent a build-up of magnetic charge within the sheet 340. Localizing magnetic forces may maintain the amount of force necessary to remove an individual magnet from the apparatus 105 such that adding additional magnetic devices to the apparatus 105 has a minor, or no, effect upon the amount of force necessary to remove individual magnets from the apparatus 105. Inclusion of the diamagnetic material and/or the ferromagnetic material may allow for the pick-and-place apparatus (or other machines or individuals) to remove an individual magnetic device from the apparatus 105, regardless of the number of magnetic devices coupled to the apparatus 105.

In another example, the height modulators (e.g., the height modulator 250 of FIG. 2, the first height modulator 350A, or the second height modulator 350B) may allow for the fine-tuning, or modulation, of the magnetic/attractive forces between a magnetic device (not shown) and the sheet 340. The height modulators 350A or 350B may include the diamagnetic material and/or the ferromagnetic material. The height modulators 350A or 350B may not include the diamagnetic material and/or the ferromagnetic material. Increasing the distance between the magnetic device and the sheet 340 may decrease the amount of magnetic forces that are generated between the sheet 340 and the magnetic device, thereby decreasing the holding force of the magnetic device within the apparatus 105. By varying the height of the height modulators, the amount of force that is generated between the magnetic device and the sheet 340 may be varied. Varying the amount of force that is generated between the magnetic device and the sheet 340 may allow for the fine-tuning of the amount of force necessary to remove the magnetic device from the apparatus 105.

The apparatus may include varying heights of height modulators, thereby allowing for a variety of magnets, with varying strengths, to be stored within an individual tray 110 of the apparatus 105. As described herein, the localization of the magnetic forces within the apparatus 105 may also prevent adjacent magnetic devices from influencing one another. In an example, a first magnetic device is placed within a first pocket, and a second magnetic device is positioned within a second pocket, wherein the first pocket is located adjacent to the second pocket. If a diamagnetic material were not included in the apparatus 105, the first magnet may be able to influence the second magnet (or vice-versa), thereby causing the second magnet to reorient itself, or otherwise move out of a desired position.

By including a diamagnetic material within the apparatus 105, the magnetic forces generated by the first magnet are localized within the first pocket such that the amount of influence the first magnet is able to exert upon the second magnet may be significantly, if not entirely, reduced. Inclusion of the diamagnetic material and/or the ferromagnetic material within the apparatus 105 may prevent the magnetic devices coupled to the apparatus 105 from reorienting themselves or otherwise moving out of a desired position. Reducing the amount of influence between adjacent magnetic devices may allow for the number of magnetic devices per unit area that are coupled with the apparatus 105 to increase, because undesirable inter-magnetic device influences are minimized or eliminated. Inclusion of the diamagnetic material may also shield the magnetic devices coupled to the apparatus 105 from external influences, such as external magnetic fields or magnetic objects that are located proximate the apparatus 105.

As discussed herein, a spacer (e.g., the spacer 260 of FIG. 2) may also be used to vary the heights of one or more height modulators, thereby allowing for a variation of the attractive forces between devices positioned within a pocket (e.g., the pocket 200 of FIG. 2) and the sheet 340.

Figure 4:
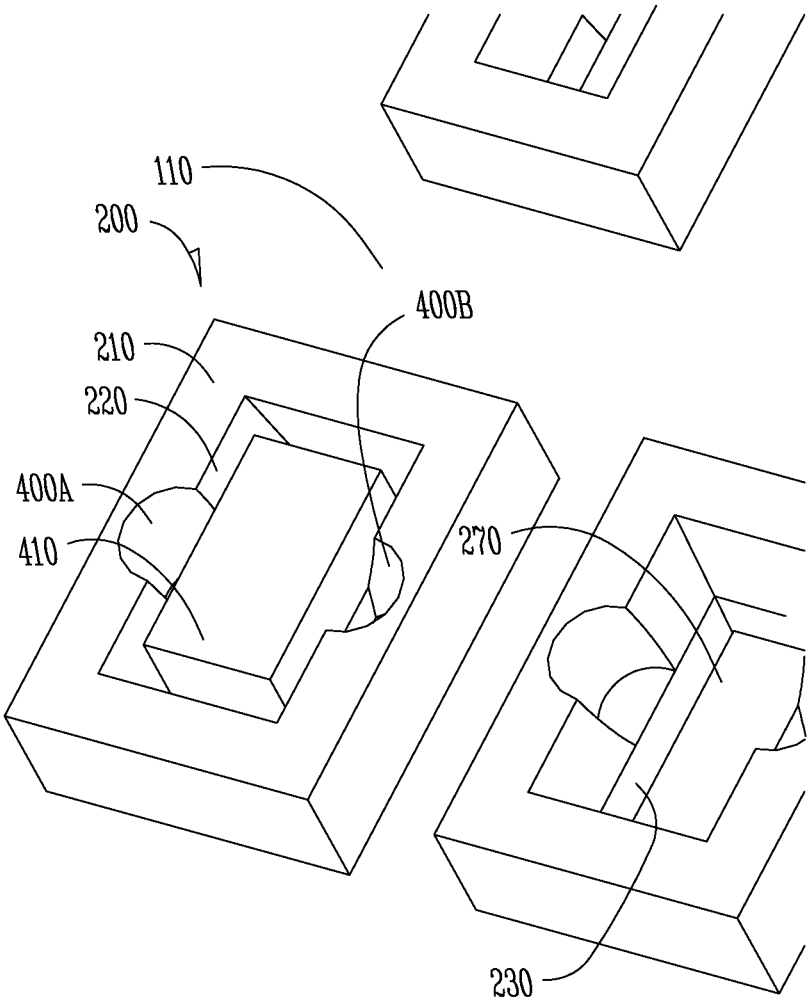
FIG. 4 illustrates a different portion of the system for storing magnetic devices of claim 1.

FIG. 4 illustrates a different portion of the system for storing magnetic devices of claim 1. The system 100 may include the apparatus 105. The apparatus 105 may include the tray 110. The tray 110 may include one or more pockets, such as a pocket 200. The pocket 200 may include pocket sidewalls 210. The pocket sidewalls 210 may define a cavity 215 (e.g., a top opening). The pocket 200 may include a chamfered surface 220. The pocket 200 may include a recess 230.

The pocket 200 may include a first cutout 400A. The pocket 200 may include a second cutout 400B. The pocket may include additional cutouts. The first cutout 400A and/or the second cutout 400B may extend into the pocket sidewall 210. The first cutout 400A and/or the second cutout 400B may be a hole that extends into the pocket sidewall 210 normal to a top surface of the pocket 210. The first cutout 400A and/or the second cutout 400B may remove material from the pocket sidewall 210 and the chamfered surface 220. The first cutout 400A and/or the second cutout 400B may extend from the recess 230 into the pocket sidewall 210.

The first cutout 400A and the second cutout 400B may be positioned on opposite sides of the pocket 200. Additional cutouts may be located on the pocket sidewalls 210 that do not include the first cutout 400A and the second cutout 400B. The first cutout 400A and/or the second cutout 400B may be configured to receive a pin. Although the first cutout 400A and the second cutout 400B shown in FIG. 4 are generally circular in cross-sectional shape, the invention is not so limited. The cutouts may be triangular, square, rectangular, or any other nth-sided polygon in cross-sectional shape.

The system 100 may include the magnetic device 410. The magnetic device 410 may mate with the bottom 270 of the pocket 200. The bottom 270 of the pocket 200 may be the top surface of a height modulator (e.g., the height modulator 250 of FIG. 2, the height modulator 350A of FIG. 3, or the height modulator 350B of FIG. 3). Positioning the magnetic device 410 within the pocket 210 may be eased by the chamfered surface 220. The magnetic device 410 may reside within the recess 230 during storage. The recess 230 may be sized and shaped (e.g., have dimensions slightly larger than the magnetic device 410) to contribute to the prevention of the movement (or reorientation) of the magnetic device 410 within the pocket 200.

VARIOUS NOTES

The above description includes references to the accompanying drawings, which form a part of the detailed description. The drawings show, by way of illustration, specific embodiments in which the invention may be practiced. These embodiments are also referred to herein as "examples." Such examples may include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Geometric terms, such as "parallel", "perpendicular", "round", or "square", are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

Method examples described herein may be machine or computer-implemented at least in part. Some examples may include a computer-readable medium or machine-readable medium encoded with instructions operable to configure an electronic device to perform methods as described in the above examples. An implementation of such methods may include code, such as microcode, assembly language code, a higher-level language code, or the like. Such code may include computer readable instructions for performing various methods. The code may form portions of computer program products. Further, in an example, the code may be tangibly stored on one or more volatile, non-transitory, or non-volatile tangible computer-readable media, such as during execution or at other times. Examples of these tangible computer-readable media may include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments may be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments may be combined with each other in various combinations or permutations. The scope of the invention should be determined with reference to the appended claims, along with the full scope of equivalents to which such claims are entitled.

The claimed invention is:

1. An apparatus for storing magnetic materials, comprising:

a tray including one or more pockets, wherein each of the one or more pockets is configured to receive a magnetic device;

a sheet configured to couple with the tray and located adjacent to a surface of the one or more pockets, wherein the sheet includes:

a diamagnetic material or a ferromagnetic material;

a first set of height modulator protrusions, wherein the first set of height modulator protrusions protrude from a surface of the sheet and each of the first set of height modulator protrusions is configured to extend into a corresponding one of the one or more pockets at a first distance and each of the first set of height modulator protrusions is contained within the corresponding one of the one or more pockets.

2. The apparatus of claim 1, wherein the ferromagnetic material is selected from the group consisting of iron, nickel, cobalt, and gadolinium.

3. The apparatus of claim 1, wherein the sheet includes a composite material, and the composite material includes a dielectric matrix and a dispersed phase, wherein the dispersed phase includes the diamagnetic material or the ferromagnetic material.

4. The apparatus of claim 1, wherein the sheet is a first sheet and the tray includes a first section and a second section, and the first sheet is configured to couple with the first section of the tray, and further comprising a second sheet configured to couple with the second section of the tray, wherein the second sheet includes:

the diamagnetic material or the ferromagnetic material; and a second set of height modulator protrusions, wherein the second set of height modulator protrusions protrude from a surface of the second sheet and each of the second set of height modulator protrusions is configured to extend into a corresponding one of the one or more pockets of the second section.

5. The apparatus of claim 4, wherein the first set of height modulator protrusions each have a first height, the second set of height modulator protrusions each have a second height, and the first height is different than the second height.

6. The apparatus of claim 4, wherein the one or more pockets of the first section have a first set of dimensions, the one or more pockets of the second section have a second set of dimensions, and the first set of dimensions is different than the second set of dimensions.

7. The apparatus of claim 1, wherein the one or more height modulator protrusions include the diamagnetic material or the ferromagnetic material.

8. The apparatus of claim 1, wherein the one or more pockets each include an opening, wherein the opening for each of the one or more pockets are sized and shaped to receive the first set height modulator protrusions.

9. The apparatus of claim 1, wherein the first set of height modulator protrusions includes a first height modulator protrusion and a second height modulator protrusion, wherein the first height modulator protrusion has a first height and the second height modulator protrusion has a second height, and wherein the first height is different than the second height.

10. The apparatus of claim 1, further comprising a spacer, wherein the spacer:

is sized and shaped to mate with the tray or the sheet and be positioned between the tray and the sheet, and includes one or more openings sized and shaped to receive each of the first set of height modulators such that an overall height of the first set of height modulators is reduced.

11. The apparatus of claim 1, further comprising a spacer including the diamagnetic material, the spacer configured to be positioned between the tray and the sheet, wherein positioning the spacer between the tray and the sheet configures the first set of height modulator protrusions to protrude into the one or more pockets at a second distance, and the second distance is less than the first distance.

12. The apparatus of claim 1, wherein each of the one or more pockets includes a top opening and a bottom opening, the first set of height modulator protrusions protrude into the one or more pockets through the bottom opening of each of the one or more pockets, and the dimensions of the top opening are greater than the bottom opening.

13. The apparatus of claim 1, wherein the tray or the sheet includes one or more interconnection features, and the one or more interconnection features are configured to mate with a JEDEC tray.

14. The apparatus of claim 1, wherein coupling of the sheet with the tray defines a cavity within each of the one or more pockets and the cavity in each of the one or more pockets is configured to receive the magnetic device.

15. The apparatus of claim 1, wherein the one or more pockets include at least one cutout extending into a sidewall of the one or more pockets.

16. The apparatus of claim 15, wherein the at least one cutout is configured to receive an individual pin.

17. A system for storing magnetic materials, comprising:

a tray including one or more pockets;

a sheet configured to couple with the tray and located adjacent to a bottom of the one or more pockets, wherein the sheet includes:

a diamagnetic material or a ferromagnetic material;

a first set of height modulator protrusions, wherein the first set of height modulator protrusions protrudes from a surface of the sheet and each of the first set of height modulator protrusions is configured to extend into a corresponding one of the one or more pockets at a first distance and each of the first set of height modulator protrusions is contained within the corresponding one of the one or more pockets;

a magnetic device; and wherein each of the one or more pockets is configured to receive the magnetic device.

18. The system of claim 17, wherein the ferromagnetic material is selected from the group consisting of iron, nickel, cobalt, and gadolinium.

19. The system of claim 17, wherein the sheet includes a composite material, and the composite material includes a dielectric matrix and a dispersed phase, wherein the dispersed phase includes the diamagnetic material or the ferromagnetic material.

20. The system of claim 17, wherein the one or more pockets include at least one cutout extending into a sidewall of the one or more pockets.

21. The system of claim 20, wherein the at least one cutout is configured to receive an individual pin.

22. The system of claim 17, further comprising a spacer wherein the spacer:

is sized and shaped to mate with the tray or the sheet and be positioned between the tray and the sheet, and includes one or more openings sized and shaped to receive each of the first set of height modulator protrusions such that each of the first set of height modulator protrusions extends into the corresponding one of the one or more pockets at a second distance, and the second distance is less than the first distance.

23. The system of claim 22, whereby configuring the first set of height modulator protrusions to extend into the corresponding one of the one or more pockets at the second distance increases the attractive force between the magnetic device and the sheet, when the magnetic device is received in the pocket.

24. The system of claim 17, wherein the one or more height modulators includes a modulator surface, and the modulator surface is configured to mate in surface to surface contact with a portion of the magnetic device when the magnetic device is received in one of the one or more pockets.

25. The system of claim 17, wherein the tray or the sheet includes one or more interconnection features, and the one or more interconnection features are configured to mate with a JEDEC tray.

26. An apparatus for storing magnetic materials, comprising:

a tray including at least one pocket, wherein the at least one pocket is configured to receive an individual magnetic device;

a diamagnetic material or a ferromagnetic material located adjacent to a bottom of the at least one pocket; and a respective height modulator protrusion disposed between each at least one pocket bottom and the diamagnetic material or ferromagnetic material, the height modulator protrusion extending its respective at least one pocket at a first distance and each height modulator protrusion is contained within a corresponding one of the at least one pocket.

27. The apparatus of claim 26, wherein the ferromagnetic material is selected from the group consisting of iron, nickel, cobalt, and gadolinium.

28. The apparatus of claim 26, wherein the height modulator includes the diamagnetic material or the ferromagnetic material.

29. The apparatus of claim 26, wherein the height modulator protrusion is a first height modulator protrusion and further comprising a second height modulator protrusion, wherein the first height modulator protrusion has a first height and the second height modulator protrusion has a second height, and wherein the first height is different than the second height, and the first height modulator protrusion and the second height modulator protrusion extend into a corresponding one of the at least one pocket.

30. The apparatus of claim 26, wherein the tray includes one or more interconnection features, and the one or more interconnection features are configured to mate with a JEDEC tray.

31. The apparatus of claim 26, wherein the at least one pocket includes at least one cutout extending into a sidewall of the at least one pocket.

* * * * *